US010000258B2

(12) United States Patent
Curtis

(10) Patent No.: US 10,000,258 B2
(45) Date of Patent: Jun. 19, 2018

(54) VESSEL WITH SELECTIVELY DEPLOYABLE HULL MEMBERS

(71) Applicant: Birdon (UK) Limited, Denver, CO (US)

(72) Inventor: Timothy Curtis, Denver, CO (US)

(73) Assignee: Birdon (UK) Limited, Denver, CO (US)

( * ) Notice: Subject to any disclaimer, the term of this patent is extended or adjusted under 35 U.S.C. 154(b) by 0 days. days.

(21) Appl. No.: 15/598,386

(22) Filed: May 18, 2017

(65) Prior Publication Data

US 2017/0334523 A1 Nov. 23, 2017

Related U.S. Application Data

(60) Provisional application No. 62/338,140, filed on May 18, 2016.

(51) Int. Cl.

| | |
|---|---|
| ***B63B 1/10*** | (2006.01) |
| ***B63B 1/14*** | (2006.01) |
| ***B63H 11/02*** | (2006.01) |
| ***B63H 1/14*** | (2006.01) |

(52) U.S. Cl.

CPC ..... *B63B 1/107* (2013.01); *B63B 1/14* (2013.01); *B63H 1/14* (2013.01); *B63H 11/02* (2013.01); *B63B 2001/145* (2013.01)

(58) Field of Classification Search

CPC .. B63B 1/107; B63B 1/14; B63B 1/18; B63B 1/20; B63H 1/14; B63H 11/02

USPC ..... 114/283, 284

See application file for complete search history.

(56) References Cited

U.S. PATENT DOCUMENTS

| | | | | |
|---|---|---|---|---|
| 1,710,625 | A * | 4/1929 | Kapigian | B63B 43/14 114/123 |
| 3,998,176 | A * | 12/1976 | Stout | B63B 1/22 114/271 |
| 4,669,408 | A * | 6/1987 | Schad | B60F 3/0061 114/283 |
| 4,821,663 | A * | 4/1989 | Schad | B60F 3/0061 114/283 |
| 5,540,170 | A | 7/1996 | Purdy | |
| 5,829,376 | A | 11/1998 | Kostanski | |
| 5,988,097 | A * | 11/1999 | Karney | B63B 1/22 114/283 |
| 7,194,972 | B2 | 3/2007 | Schmitz, Sr. | |
| 2003/0089293 | A1 | 5/2003 | Vos | |
| 2015/0259033 | A1 | 9/2015 | George et al. | |

* cited by examiner

*Primary Examiner* — Lars A Olson

(74) *Attorney, Agent, or Firm* — Robert Devin Ricci; Kean Miller LLP

(57) ABSTRACT

A vessel is provided herein which comprises a primary hull and at least two hull members capable of being deployed from or retracted into tunnels or underneath overhangs in the primary hull. In various embodiments, the vessel comprises a means for controllably deploying and retracting the hull members. These members may further comprise a propulsion means capable of propelling the vessel. In other embodiments the vessel comprises a failsafe mode allowing the hull members to fully retract into the vessel during times of destress. In various embodiments, the vessel is a landing craft capable of loading and unloading cargo without the burden of an overhang cross beam.

20 Claims, 7 Drawing Sheets

VESSEL WITH SELECTIVELY DEPLOYABLE HULL MEMBERS

CROSS REFERENCE TO RELATED APPLICATIONS

This application claims priority to two U.S. provisional applications: (1) U.S. application No. 62/338,140, entitled Deployable SWATH Vessel, filed May 18, 2016, and (2) U.S. application No. 62/393,148, entitled Vessel with Selectively Deployable Hull Members, filed Sep. 12, 2016.

FIELD OF THE DISCLOSURE

The present disclosure relates, in some embodiments to a nautical vessel with two or more independent hull members connected to a central primary hull wherein the location of hull members can be controllably manipulated relative to the primary hull and to the sea in order to alter the draft of the vessel. More specifically, the disclosure provides for a vessel having a primary hull with one or more deployable hull members that are capable of movement independent of primary hull in order to transform between one or more vessel configurations selected from a group comprising barge mode, hydrofoil, catamaran, SWATH, and any variations thereof.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

DESCRIPTION OF THE DRAWINGS

The drawings constitute a part of this specification and include exemplary embodiments of the Vessel with Selectively Deployable Hull Members, which may be embodied in various forms. It is to be understood that in some instances, various aspects of the invention may be shown exaggerated or enlarged to facilitate an understanding of the invention. Therefore the drawings may not be to scale.

BACKGROUND

Figure 1:
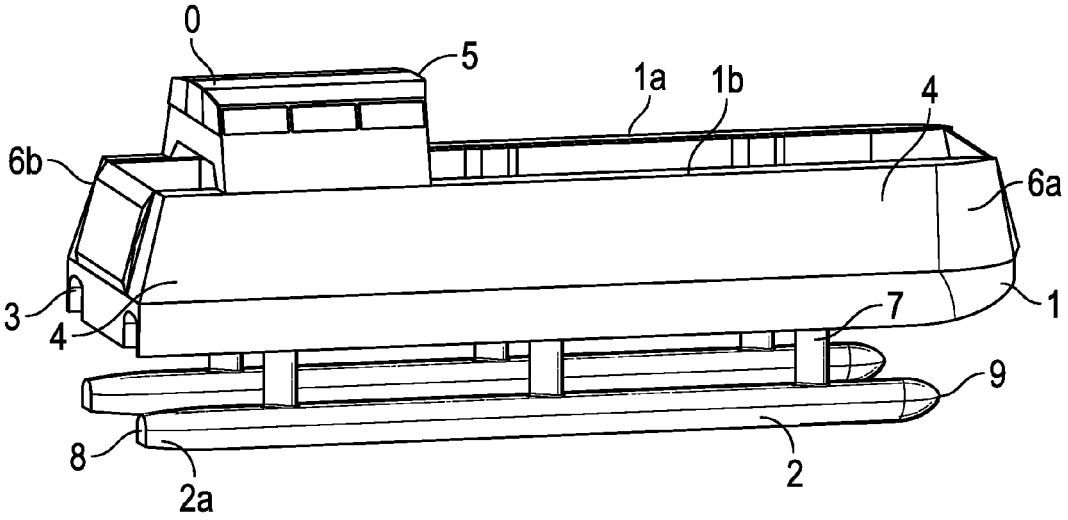
FIG. 1 is a side angled view of one embodiment of the present invention which depicts a SWATH landing vessel with its twin hulls deployed.
Figure 2:
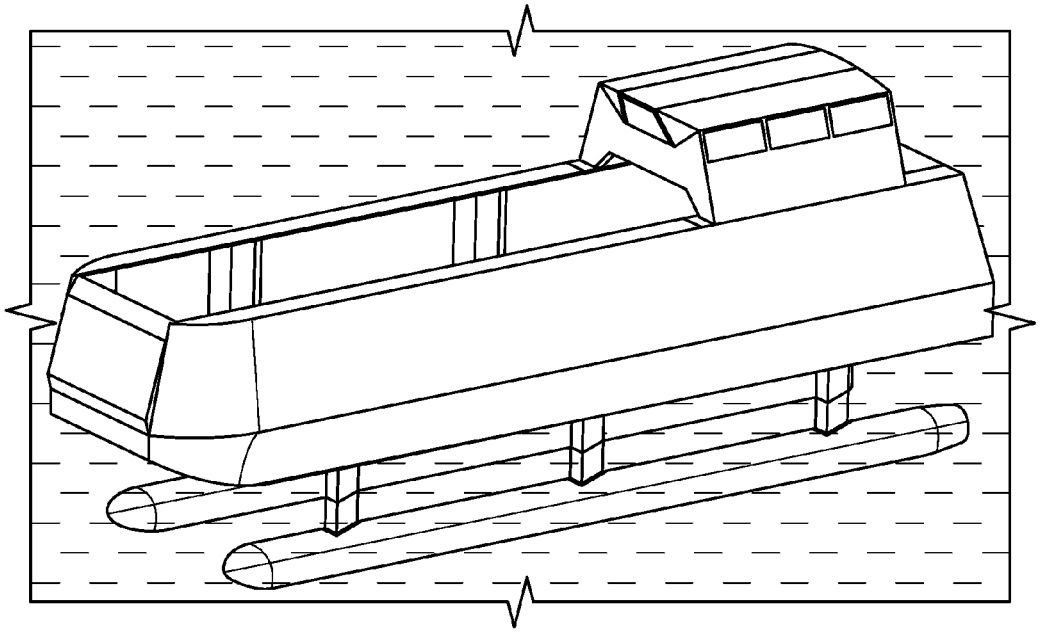
FIG. 2 is a front angled view of the same vessel in FIG. 1.
Figure 3:
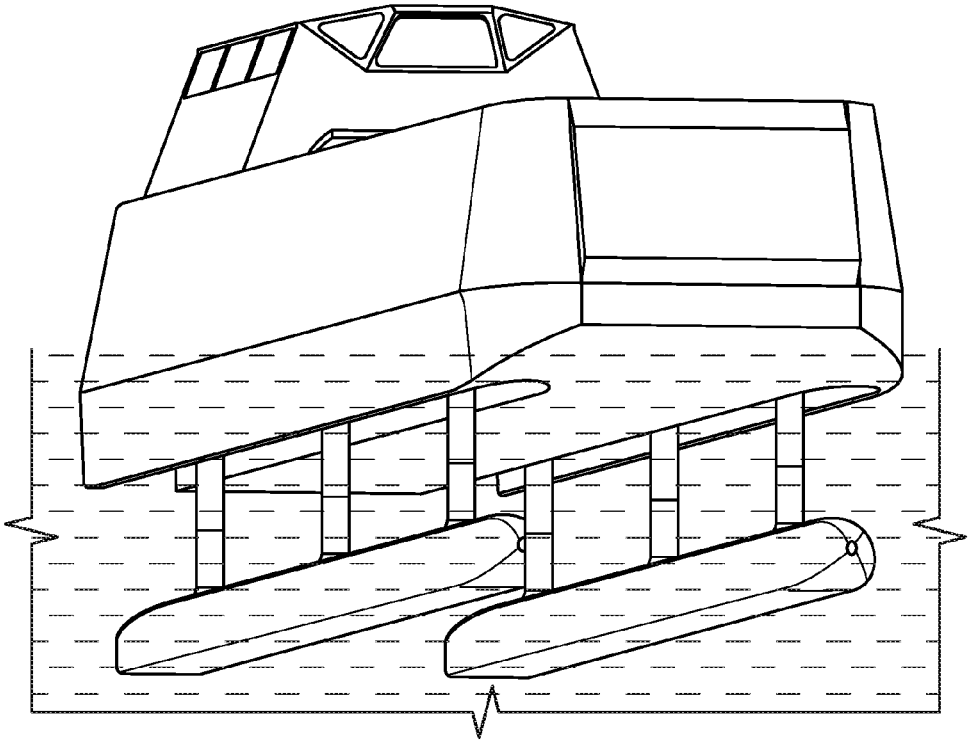
FIG. 3 is a rear angled view of the same vessel in FIG. 1.
Figure 4:
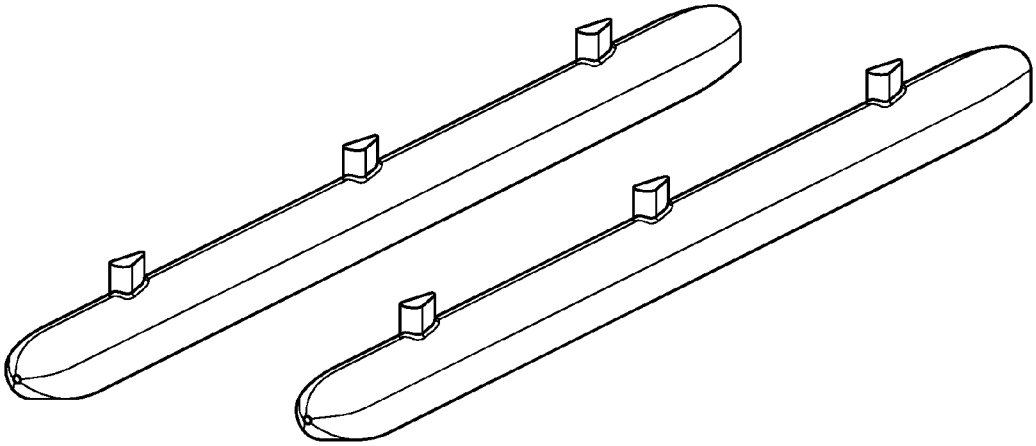
FIG. 4 is a cut view of the twin hulls from FIGS. 1-3.
Figure 5:
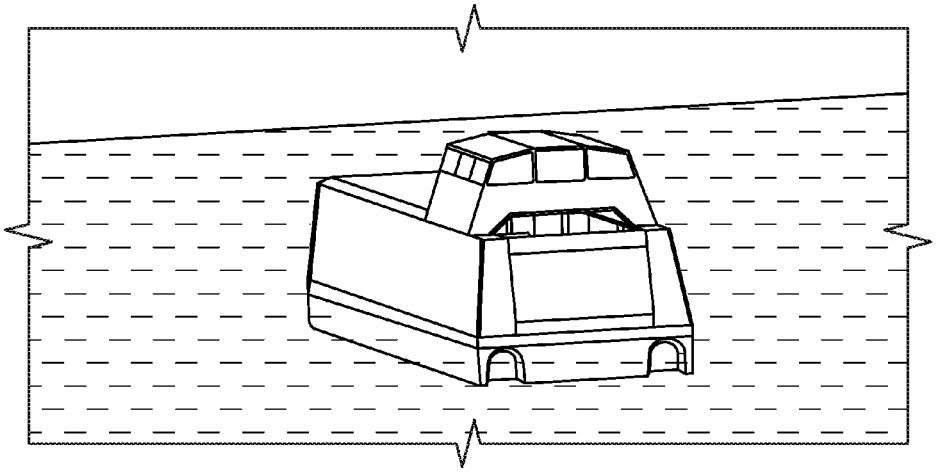
FIG. 5 a rear angled view of the same vessel of FIG. 1 with the twin hulls retracted into the primary hull.
Figure 6:
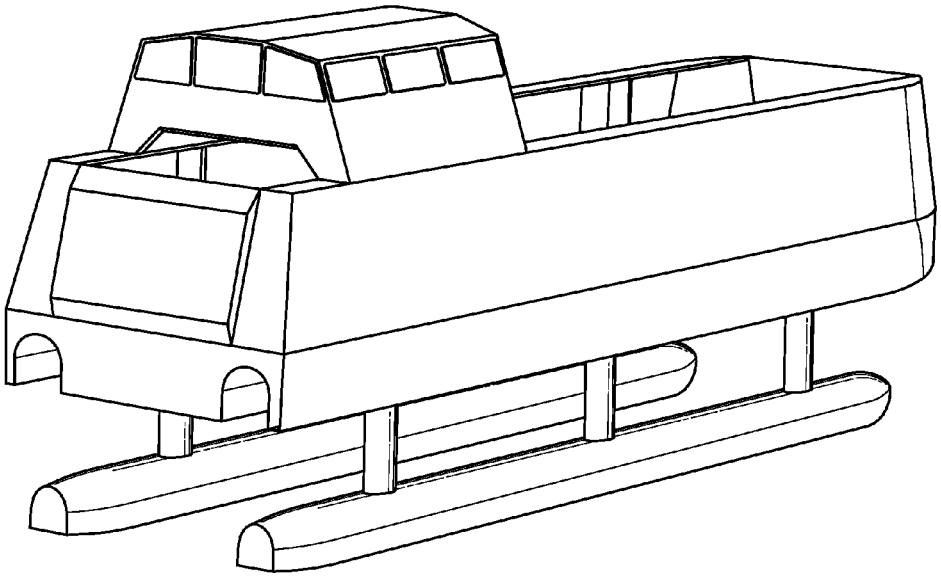
FIG. 6 is a rear angled view showing the same vessel in FIG. 5 with the twin hulls deployed.
Figure 7:
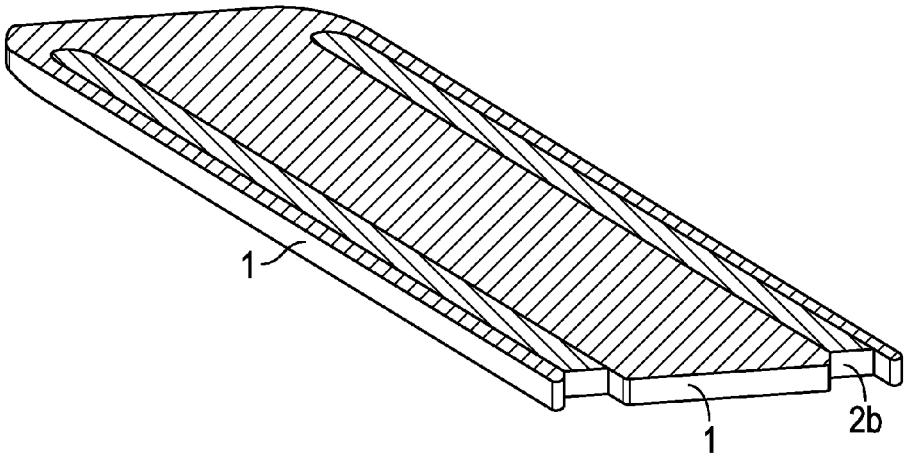
FIG. 7 is a cross-sectional view showing the primary hull with the twin hulls retracted.

Nautical vessels continue to be at the forefront of trade, transportation, and military focus. Specialized ships are constantly being designed to fit particular needs in these fields. However, the more specialized a ship's design, the more narrow its overall function.

Vessel draft plays an important role in the vessel's stability, with deeper drafts generally providing greater stability and the ability to operate at faster speeds. Draft is a function of many components, most primarily a function of the vessel's hull design. Historically, vessel hulls are either traditionally optimized for use in either shallow water or in deep water. Shallower waters necessitate a vessel with low draft to prevent grounding and allow beaching. However, although a shallow draft may allow for operation in shallower waters, this comes at a price as shallow draft vessels do not operate well in open seas or at high speed.

This is the reason that barges are typically used in shallow water while deep draft vessels like large cargo vessels and are used for heavy seas. It is common for a deep draft cargo vessel to stop at a port that can accommodate its draft and unload the cargo onto shallower draft barges. The large surface area of a barge creates enough displacement to reduce the draft of these vessels, allowing them to traverse more shallow channels.

Attempts have been made to create variable draft vessels that can be manipulated to function at various levels of draft to suit a particular need. These attempts have provided vessels with varying degrees of success; however, each has continued to suffer from major setbacks and problems. The instant invention seeks to provide a multi-use vessel with two or more independent hull members connected to a central primary hull wherein the location of hull members can be controllably manipulated relative to the primary hull and to the sea in order to alter the draft of the vessel.

DESCRIPTION OF MODES

A catamaran is a vessel consisting of two separated hulls joined by a frame. As used herein, "Catamaran" or "Catamaran mode" refers to the configuration of the vessel wherein the hull members are extended so as to lift the primary hull of the vessel out of the water, but the pontoons are not entirely submerged. This configuration offers greater stability and increased speeds than traditional monohulls.

As used herein, the term "barge" or "barge mode" refers to the configuration of the vessel wherein the hull members are completely retracted such that the primary hull is in contact with the surface of the water, thereby providing at least some buoyancy for the vessel. This configuration may be ideal during landing for unloading/loading of cargo and during failsafe operation as described herein.

In general, "SWATH" stands for a Small-Waterplane-Area Twin Hull. In its simplest sense, a SWATH is a twin-hull vessel designed to minimize hull cross section area at the sea's surface, thereby minimizing the vessel's volume near the surface area of the sea or other body of water in which the vessel is located. Instead, a bulk of the displacement necessary to keep the vessel afloat is located in the twin hulls which are projected into the sea where they are located beneath the waves. In many circumstances, it can be advantageous to reduce the surface area and volume of the vessel at the sea's surface where wave energy is located. Minimizing the volume near the surface area maximizes the vessel's stability, even in high seas or at high speeds because the primary hull will not come into contact with the opposing wave forces. Thus, as used herein with reference to the position of the hull members, the term "SWATH" or "SWATH Mode" refers to the SWATH-type hull members being completely extended so as to lift the primary hull of the vessel out of the water, but with the hull members submerged under water.

DETAILED DESCRIPTION

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the term "module" might be used herein to connote different components of systems employed, the terms should not be interpreted as implying any particular order among or between various steps herein disclosed unless and except when the order of individual steps is explicitly described.

Furthermore, the described features, structures, or characteristics may be combined in any suitable manner in one or more embodiments. In the following description, numerous specific details are provided, such as examples of vessels, water jets, deploying means, and sensors. One skilled in the relevant art will recognize, however, that the Vessel with Selectively Deployable Hull Members may be practiced without one or more of the specific details, or with other methods, components, materials, and so forth. In other instances, well-known structures, materials, or operations are not shown or described in detail to avoid obscuring aspects of the invention. Other components and apparatuses may be conceived that are equivalent in function, logic, or effect to one or more mechanisms, or portions thereof, of the illustrated Vessel with Selectively Deployable Hull Members.

The Vessel with Selectively Deployable Hull Members as described herein is a marine vessel that comprises a novel type of marine vessel hull form that allows for numerous configurations to maximize the versatility of the vessel for operation conditions. By way of illustrative example only, the ideal configuration is completely different with varying vessel drafts. These differences can be accounted for and optimized via retractable hull extensions (referred to herein as hull members) that extend and retract from positions within or adjacent to the primary hull. The deployable hull members convert a high speed catamaran into a shallow draft landing craft in barge mode. For example, when the vessel is traveling along open waters, the hulls can be deployed to catamaran or SWATH mode to raise the main hull clear of the water to decrease contact friction and maintain higher seakeeping ability. When the vessel is in shallow water, for example during unloading and loading of cargo or barge mode, the hulls can be retracted to account for a shallow draft.

It is to be understood that the concept set forth and claimed herein can be incorporated into numerous types of vessels. For illustrative purposes only, and not to be limiting, an embodiment of a vessel with selectively deployable hull members is provided herein and depicted in FIGS. 1-14 as a landing craft because it is a type of vessel that may routinely switch between a slow heavy operating condition and a fast light condition or, in alternate or concurring uses, may have to limit its depth to accommodate for operations in shallower water. Turning first to FIG. 1, vessel 0 is depicted as a landing craft comprising generally, a primary hull 1, two hull members or pontoons 2 which are capable of deploying from and retracting into tunnels 3, which may also come in the form of side notches, in primary hull 1, a topside 4, a superstructure 5, bow loading door 6*a*, stern loading door 6*b*, and a non-depicted propulsion means 10. In one embodiment, the primary hull 1 is made of aluminum although other embodiments may be used. In one embodiment, the hull members 2 may be fully extended into catamaran or SWATH mode or fully retracted in barge mode. It may be advantageous in other embodiments to include other modes somewhere in between fully extended and fully retracted.

Figure 8:
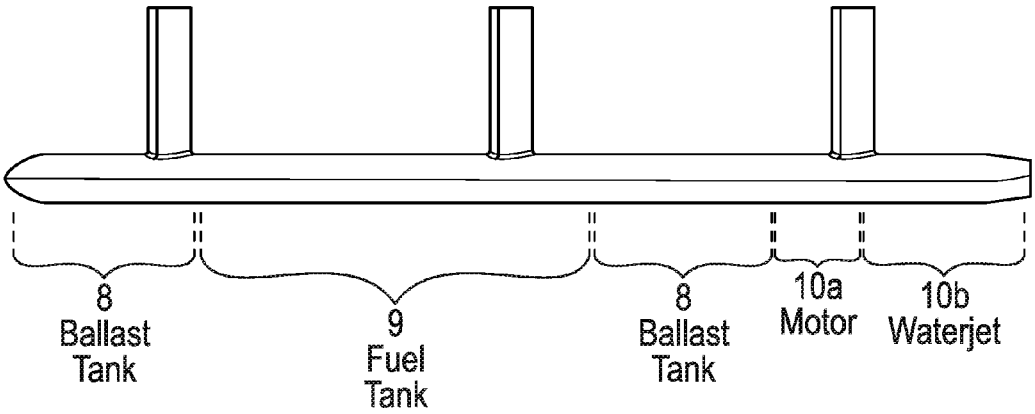
FIG. 8 is a side view of one of the twin hulls showing components of the twin hull.

Working from the bottom up of the vessel 0, the two hull members 2 comprise elongated tubular hull structures with a front of bow end 2*a* and a distal, rear or stern end 2*b*. When the hull member 2 is in the deployed position, it ideally sits below the water's surface and acts as a submarine hull as would be understood by one having ordinary skill in the art. The hull members 2 comprise hollow compartments in which various components can be housed. Turning to FIG. 8, a cross section of a hull member 2 is shown to illustrate embodiments of the hull members 2 housing interior components. For example, as illustrated, the hull members 2 house one more ballast tanks 8, a fuel tank 9 and a propulsion means 10. A ballast tank 8 is a compartment within a boat, ship or other floating structure that holds water, which is used as ballast to provide stability and/or trim the vessel. The ballast tanks 8 are filled with water or other materials to refine the buoyancy of the hull members 2 depending on the desired depth for the hull member 2 to reside. In one or more embodiments, the ballast tanks 8 can be controllably filled or drained to selectively control the buoyancy of the hull members 2. For example, in shallower water, it may be desirable to have a more buoyant hull member 2 to increase the buoyancy and thereby raise the depth at which the hull members 2 will reside. To do so, water would be pumped out of the ballast tanks 8.

In the present embodiment, a propulsion means 10 is built directly into the hull members 2. It is readily understood that the propulsion means 10 does not always have to be located within the hull member 2; however, it is necessary that the propulsion means 10 is capable of working when the hull members 2 are deployed. As depicted, the propulsion means 10 is a waterjet 10*b* powered by a motor 10*a* which received fuel fed from fuel tank 9, each component of which is in the hull member 2. In alternate embodiments, the propulsion means 10 can be one of many known in the art, including propeller driven systems attached to a motor 10*a* that either runs on fuel or electricity or a hydraulic motor. Likewise, while the fuel source is located in the hull member 2 in the present embodiment, it is possible that the source can be located in the primary hull 1 or elsewhere in vessel 0.

Additionally, since the hull members 2 may act as SWATH or catamaran hulls or pontoons when deployed, it can be advantageous to shape the hull member 2 in a manner such that it is hydrodynamic. Accordingly, the hull members 2 are typically streamlined in shape and encompass a bow end 2*a* that is shaped to facilitate a hydrodynamic glide through the water. For example, the depicted front end bow end 2*a* is bulbous in shape, although various other shapes and designs can be incorporated.

Turning back to FIGS. 1-5, the primary hull 1 is shown having a substantially planar exterior surface with longitudinal tunnels 3 running from the bow to the stern. It is readily understood that in various embodiments with different types or forms of vessels that the primary hull 1 does not have to have a substantially planar exterior and may have a curved hull. In the depicted embodiment, the tunnels 3 extend from the bow of the primary hull 1 to its stern and are diametrically larger than hull members 2 such that substantially all of hull members 2 can be housed within the tunnels 3 when in the retracted position. In alternate embodiments, it is possible that the tunnels 3 and hull members 2 may be formed in segments such that multiple hull members 2 are employed, each of which corresponds with one a number of tunnels 3 or caverns in the primary hull 1 instead of a single unitary tunnel 3 corresponding with a single unitary hull member 2.

Figure 9:
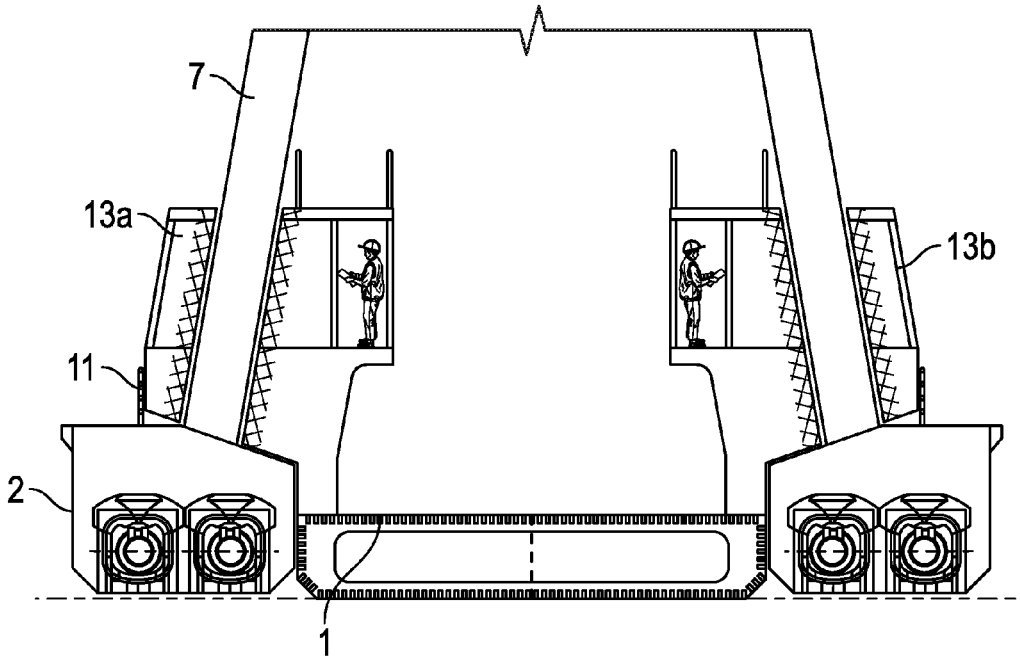
FIG. 9 is a front cutaway view of one embodiment of the present invention which depicts overhangs built out from the primary hull and personnel compartments.

FIG. 9 depicts another embodiment of the invention wherein overhangs 11 house the retracted hull members 2 rather than tunnels 3. In one embodiment overhangs 11 mirror the size of the hull members 2 in width allowing the hull members 2 to fit snug underneath the overhangs 11. As depicted the primary hull 1 further comprises a notch that corresponds in slope to a portion of the hull member 2. In another embodiment such as depicted in FIG. 9 the overhangs 11 are smaller in width than the hull members 2.

Hull members 2 are connected to the vessel 0 via support columns 7 or "struts" which extend upwards through the tunnels 3 and into the primary hull 1 whereby the support columns 7 are secured to the vessel 0 via fasteners such as bolts and other mechanical means, although they may also be welded to the vessel 0 and hull members 2. By extending through the primary hull 1 or through the overhangs 11, the support columns 7 do not obstruct access to key features such as the engine room and capstan and facilitate larger cargo areas. In one embodiment the support columns 7 are made of metal with a high fatigue tolerance and that is relatively light weight. In one embodiment, the support columns 7 are made of aluminum alloys. In another embodiment, the support columns 7 are made of steel. In further embodiments, the support columns 7 are made of a composite.

Figure 14:
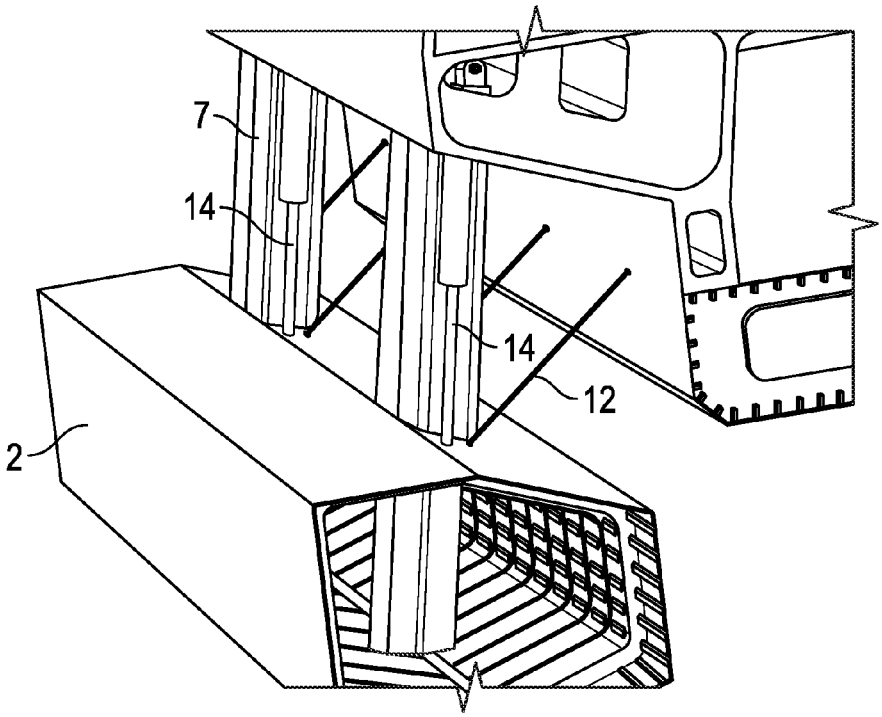
FIG. 14 depicts the tension members that connect from the hull members to the primary hull.

The vessel 0 further comprises a hull deployment means 14 which is capable of controllably deploying the hull members 2 out from the primary hull 1 and retracting the hull members 2 back towards the primary hull 1 such that they are substantially housed within the overhangs 11. One embodiment of the deployment means 14 is depicted in FIG. 14. It may be beneficial to include an interlock to prevent the vessel 0 from changing modes at higher speeds. In one embodiment, the interlock restricts the transitioning of hull members 2 between the various modes at a pre-set speed limit, such as, for example, below four knots.

Numerous forms of deployment means can be utilized to controllably deploy and retract the hull members 2. One embodiment of a deployment means 14 is depicted in FIG. 14. Some illustrative examples may include motors, hydraulic pumps, electric motors, mechanical winches, hydraulic cylinders and combinations thereof. For example, in an embodiment, the support columns 7 each use redundant synchronized hydraulic cylinders to raise and lower the hull members 2 in unison to shift between the various modes. In one embodiment, the hull members 2 can be fully extended or retracted, 10-foot total stroke, in approximately two minutes. In this embodiment, when the hull members 2 are fully extended or fully retracted, a hydraulically operated locking pin system engages to unload the hydraulic cylinders from the dynamic loads of the vessel. This feature allows the vessel to remain in the designated mode without relying on active hydraulic pressure. The locking pins can be hydraulically or manually disengaged to allow the vessel to return to barge mode in the unlikely event of a system power failure, enabling the vessel to safely complete its mission. This key feature eliminates the risk of system abort and assures continuity of operations. The raising and lowering system uses conventional commercial hydraulic cylinders which are synchronized to prevent racking forward and aft. In an embodiment, the port and starboard side hull members 2 are also synchronized to ensure that the vessel raises and lowers symmetrically.

In one embodiment, the control system features Programmable Logic Controller (PLC) technology. In this embodiment, the PLC-based lift system controls each lift cylinder by modifying the command to each proportional valve as a function of each lift cylinder position, which is measured in real time via position sensors. Additionally, the main PLC concurrently can monitor the different sensors and displays values/errors on the operator panel. Redundancy is achieved and single-point failure analysis is used when designing all aspects of the PLC control system and all portions of the supply of the hydraulic system. In this embodiment, the support columns 7 are guided by rollers and bearing plates to restrain the transverse and longitudinal loading. The vertical loading may be restrained by the hydraulic cylinders during the transition phase, and the hydraulically-controlled locking pins control vertical loading during operation. The hydraulic locking pins allow the system to remain in the desired mode without requiring hydraulic pressure or overstressing the system.

It may be beneficial for the primary lift hydraulic cylinders to operate at low pressures to maximize life. In one embodiment, each support column 7 has two cylinders for raising and lowering. In the event of a cylinder failure, only one cylinder is required to actuate the system using increased hydraulic pressure. This is yet another key feature of the design which is included to mitigate risk of system abort. The lift cylinders are mounted rod-down to protect the seals from debris ingestion, and each cylinder is oriented to compensate for the maximum loading in tension and the minimum loading in compression. This orientation approach reduces the buckling loads on the cylinder rods for optimized performance and durability.

In other embodiments, electric linear actuators are used as the hull deployment means. In another embodiment a screw drive is used as the hull deployment means. The screen and screw drive may be made of suitable metals. In yet another embodiment, a rack and pinion drive may be used. A rack and pinion drive is similar to a Flender drive.

It is desirable that the deployment and retraction be controlled. To accomplish this, the hull deployment means is in electronic communication with a control panel through which a user is capable of controlling the deployment and retraction of the hull members 2. To aid in this endeavor, sensors can be mounted onto the hull members 2 or to the support columns 7 so that the user or automated control panel will be able to detect the location and speed of the hull member 2 during deployment and retraction so as to allow for correction to ensure proper deployment or proper retraction.

Likewise, in one or more embodiments, it may be desirable that portions of the hull members 2 are capable of being raised and lowered at different speeds or amounts such that the front or back of the hull member 2 may be deeper or shallower than the distal end 2*b*. To accommodate this feature, separate deployment means can be attached to the front support columns 7 and the back support columns 7, allowing for each to be deployed or retracted at different speeds.

Figure 12:
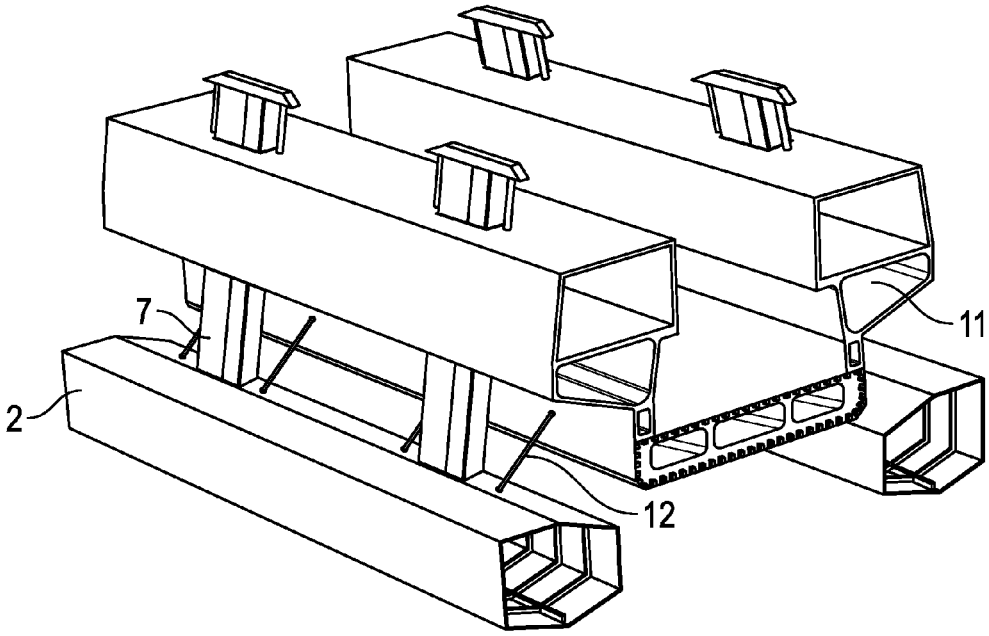
FIG. 12 is a side angled view of the vessel in FIG. 9 depicting the catamaran mode.
Figure 13:
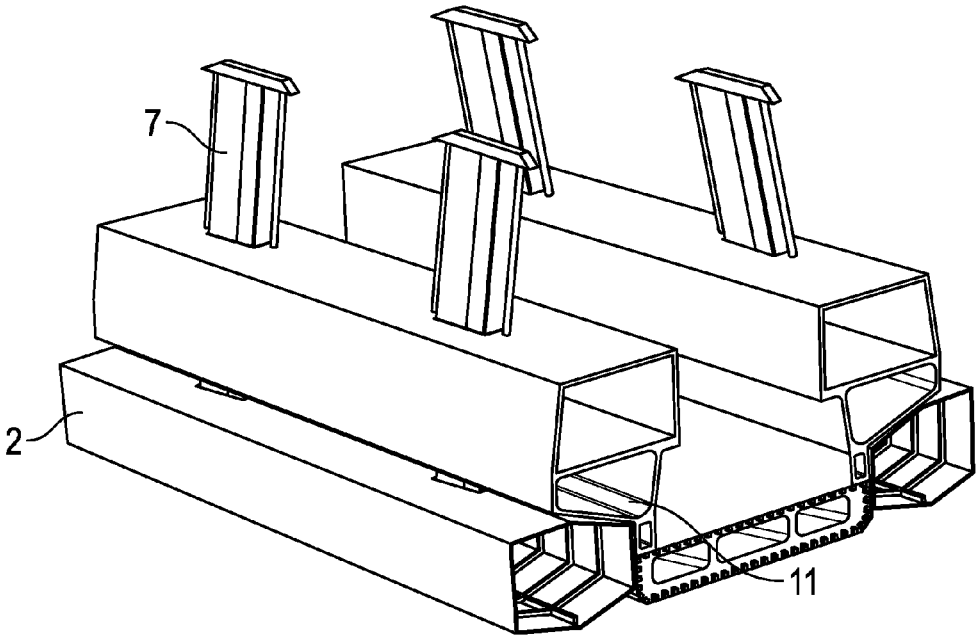
FIG. 13 is a side angled view of the vessel in FIG. 9 depicting the landing craft mode.

In the previously discussed embodiments hull members are moveable between two general positions—fully extended from the primary hull 1 or fully retracted into the primary hull 1. FIG. 12 depicts the present embodiment in fully extended catamaran mode. FIG. 13 depicts the present embodiment in fully retracted barge mode. However, in one or more embodiments, it may be desirable to provide a full range of zones for deployment. Thus, a tri-mode (or quad mode, etc.) extendable vessel may be used wherein the hull members 2 can be manipulated between three (or more) zones of extension: no extension, partial extension, and full extension.

FIGS. 14 and 12 depict optional tension members 12. In the present embodiment, the vessel features these tension members which connect the hull members 2 to the primary hull 1. The tension members 12 reduce loading on the support columns 7 and mitigate high bending moments on the support columns 7 due to transverse hull-loading in the outward direction during operations. In one embodiment the tension members 12 are made of a strong, malleable metallic material that is capable of bending around the primary hull 1 when the hull members 2 are retracted. In one embodiment the tension members 12 are made of steel cable.

Figure 11:
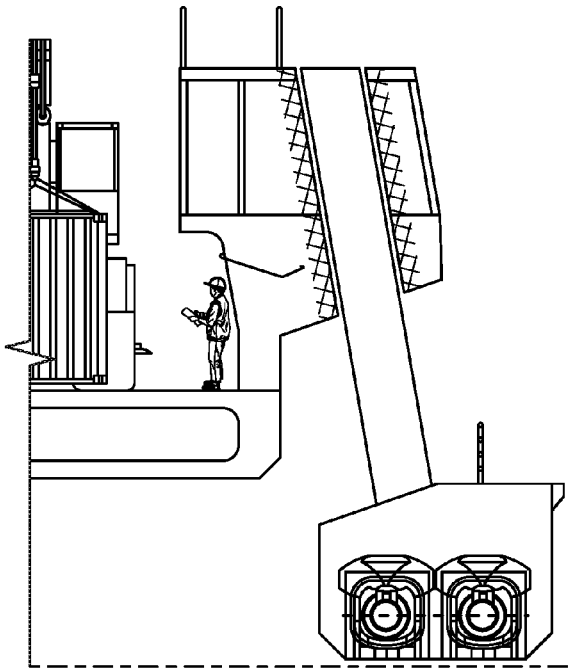
FIG. 11 is a cut away view of the vessel in FIG. 9 depicting the catamaran mode.

In one or more embodiments, it may be advantageous to deploy the hull members 2 at an angle to minimize heave and pitch motions. To accommodate this desire, the hull members 2 do not have to extend vertically, but can instead be extended at numerous angles controlled by the user. Additionally, the angle at which the hull members 2 are deployed relative to the primary hull 1 can be manipulated to adjust for displacement and stabilization. The present embodiment depicted in FIG. 11 shows the support columns 7 extending at an angle to be controlled by the user. The angled support columns 7 depicted are designed to bring the primary hull 1 and hulls members 2 together without sliding on one another. This prevents debris buildup between the primary hull 1 and hull members 2, increases damage tolerance, and eliminates binding issues associated with torsional or transverse loading. In this embodiment, when the hull members 2 are lowered from the primary hull 1, they not only move downward but also outward to increase clearance during hull member 2 extension. This embodiment also increases the vessels 0 stability in catamaran or SWATH mode, and reduces the beam in barge mode for higher maneuverability and speed.

As depicted in FIG. 9, the primary hull 1 comprises a topside 4 which is a substantially planar surface surrounded by side walls or gunwales. In the present embodiment, the primary hull 1 has independent buoyancy. One feature of the independent buoyance is that it creates, along with the hull members 2, a failsafe positive design. The hull members 2 retract, and the primary hull 1 inherently lowers, transforming the vessel into its barge configuration when the vessel is in distress. This embodiment mitigates the risk of system abort due to lift mechanism malfunction during operations. The failsafe configuration is capable of beaching and loading or unloading, transiting long distances in open water, and interfacing with a mother ship. In this embodiment, the primary hull 1 has independent buoyance and receives additional impact damage protection from the hull members 2 in a retracted state. Additionally, in one or more embodiments, it may be advantageous for a quick release to be incorporated into the vessel 0 that would allow for a hull member 2 to be jettisoned or released in the event that the hull member 2 became stuck or damaged or if the hull deployment means 14 malfunctioned. The independent buoyancy of the primary hull 1 allows for this feature. Likewise, it may be advantageous for a propulsion means 10 to be mounted directly onto the primary hull 1 in addition to the propulsion means 10 located in the hull members 2. This additional propulsion means 10 would allow for greater propulsion when the hull members 2 are retracted and can act as a backup in the event that the hull members 2 are rendered inoperational.

Figure 10:
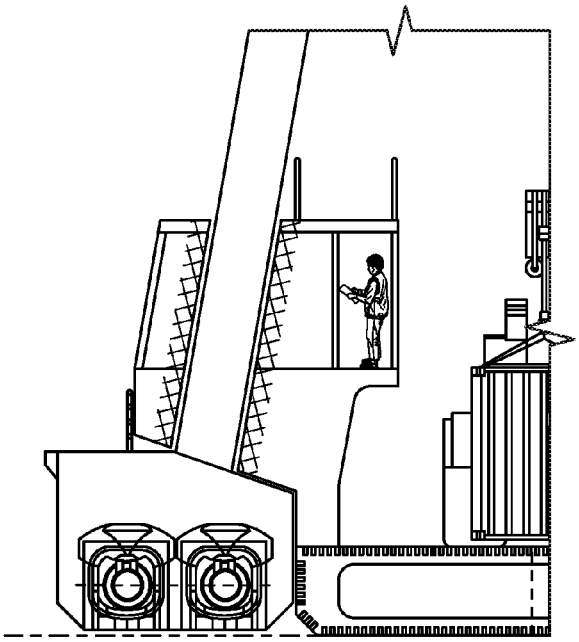
FIG. 10 is cut away view of the vessel in FIG. 9 depicting the landing craft mode.

FIGS. 10, 11, and 15 depict an embodiment with two compartments 13*a* and 13*b* which are capable of housing vessel personnel and equipment such as navigational equipment. The compartments 13*a*, 13*b* are located within the primary hull 1 and contain a cavern that has an area larger than the area of the support columns 7. Therefore, in the present embodiment, the support columns 7 are able to retract and extend by moving through the compartment 13*a*, 13*b*. The hull members 2 may provide additional buoyancy for the overhang compartment structures.

As previously indicated, the Vessel with Selectively Deployable Hull Members can be incorporated into numerous types of vessels such as ships, boats, smaller rafts, watercrafts and other similar vessels. However, in the instant embodiment, a landing craft is shown such as one that can be used for cargo transport. Two loading doors 6*a* or 6*b* are incorporated into the vessel 0 that give access to the topside 4, a bow loading door 6*a* located in the front of the vessel 0 and a stern loading door 6*b* located on the rear of the vessel 0. These doors hinged to the topside 4 of the vessel 0 and are capable of being pivoted on the hinge and lowered so as to form a ramp when the loading door 6*a* or 6*b* is open. On top of the topside 4 is superstructure 5 which houses the controls for the vessel 0 including the control panel 12 that is used to control the deployment means 14 and the propulsion means 10.

The depicted embodiment does not contain an overhead cross-beam between the primary hull 1 sections 1*a*, 1*b*. The lack of overhead cross-beams between the hull sections allows the cargo deck height to be aligned with quay walls or other vessels during loading and unloading operations without restriction, enabling shallow approach and departure ramp angles. The open deck design enables tall equipment to be loaded, shipped, and offloaded in its operational configuration. This saves time during deployment operations, and the inherent roll-on/roll-off drive-through design efficiently and effectively enables expeditionary maneuvers. The single lower beam structure of the topside 4 eliminates the need for upper cross-connect beams which could force the ramp angle to be steep when pulled up to a quay wall or pier.

In this embodiment, when using a crane or helicopter to load/unload cargo on the vessel 0, the open access of the topside 4 eliminates the possibility of catching the cable or cargo on a cross-connect beam. Structurally, the continuous beam center hull section of the topside 4 provides significant strength and life relative to using a series of highly stressed individual cross-connect beams. The full hull-length beam also handles the torsional effects induced by wave loads on the hulls during heavy seas far better than a series of cross-connect beams.

In another embodiment, the vessel is used for troop transport. When troops or equipment have to be transported to a beach or other land that may involve travel through shallower waters, the landing vessel 0 will be used. Equipment such as a tank or other armored vehicle may be loaded onto the landing vessel 0 through either or both bow loading door 6*a* or stern loading door 6*b* and will be parked onto the topside 4. Because the carrier is often parked offshore in deeper waters, the captain of the landing vessel 0 can operate the control panel 12 to controllable deploy the hull members 2 such that they extend outwards from the primary hull 1 and submerge into the water, providing the requisite displacement to lift the vessel 0 above the surface of the water. By doing so, the landing vessel 0 will greatly reduce its volume at the surface of the water, thereby increasing the vessel's 0 stability in the water and decreasing the effect that wave excitation will have on the vessel 0. This will allow the vessel 0 to travel at higher speeds than if it were employing only its primary hull 1. The vessel 0 will be propelled through the propulsion means 10 housed within the hull members 2. As the vessel 0 approaches land and shallower water, it will not be able to operate with deployed hull members 2. To proceed towards the beach, the captain of the vessel 0 will controllably retract the hull members 2 into the tunnels 3 in the primary hull 1, thereby causing the primary hull 1 to come into contact with the surface of the water. Once the vessel 0 has reached the beach, the appropriate loading door 6*a* or 6*b* is lowered on its hinge, creating a ramp onto the beach for the tank or other equipment to be moved from the topside 4 onto the beach. After the equipment is unloaded, the loading door 6*a* or 6*b* is raised, and the vessel 0 is free to return to the carrier. Once the vessel 0 has reached a permitted depth, the captain can again deploy the hull members 2 thereby reducing the volume at sea level to allow for a faster and more stable return trip. It should be mentioned that in various embodiments, the hulls do not need to be deployed to full extension and may instead be deployed to create a catamaran-configuration. The hulls may be extended to various lengths and at various angles in order to maintain top speeds while maintaining stability. This may be particularly useful, for example, in unladen transit. Safety measures may be employed to help lock the hulls into desired positions. In one or more embodiments, the deployment means will be capable of securing the hulls into a desired position without utilizing external safety means.

In another embodiment, the vessel may be used as a ferry to shuttle, for example, cars and persons across a body of water. The catamaran or SWATH mode allows for the ferry to travel quickly between shores to increase efficiency of the service. The barge mode then facilities the cars to disembark from the ferry when the appropriate loading door 6*a* is lowered creating a ramp for the cars to traverse.

In yet another embodiment, the vessel incorporates hydrofoils either as the hull members 2 or in conjunction with catamaran-type or SWATH-type hull members. A hydrofoil vessel incorporates the use of hydrofoils to propel the vessel at relatively faster speeds than a traditional vessel.

For the purpose of understanding the Vessel with Selectively Deployable Hull Members, references are made in the text to exemplary embodiments of a Vessel with Selectively Deployable Hull Members, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the Vessel with Selectively Deployable Hull Members may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change to the basic function to which it is related.

The invention claimed is:

1. A nautical vessel comprising:

a. a primary hull with a base facing external to the vessel further comprising at least two overhangs in the base of the primary hull;

b. at least two hull members each comprising a longitudinally extending hull body with a front end and a distal end;

c. a control system capable of controllably deploying and retracting the hull members and sensors in electronic communication with said control system for determining the location of the hull members; and, d. at least one propulsion means capable of propelling the vessel when the at least two hull members are either in the deployed or retracted positions, wherein at least a portion of each hull member is capable of being housed underneath the overhangs in the base of the primary hull when in the retracted position.

2. The vessel of claim 1 wherein a propulsion means is located in at least one of the at least two hull members.

3. The vessel of claim 1 wherein at least one propulsion means is located in each of said at least two hull members.

4. The vessel of claim 1 wherein the propulsion means is selected from a group comprising a water jet or a propeller attached to an engine.

5. The vessel of claim 1 wherein said control system is driven by a driving force selected from a group comprising hydraulic pumps, motors, electric motors, or a mechanical crank shaft.

6. The vessel of claim 1 wherein each said hull member is connected to the vessel through at least one support column.

7. The vessel of claim 1 wherein said control system is also capable of controlling the propulsion means.

8. The vessel of claim 1 wherein the control system is capable of deploying or retracting portions of the member hulls at different rates relatively to each other.

9. A nautical vessel comprising:

a. a primary hull with a base facing external to the vessel further comprising at least two overhangs in the base of the primary hull;

b. at least two hull members each comprising a longitudinally extending hull body with a front end and a distal end;

c. a means for controllably moving the at least two hull members to and from a deployed position and a retracted position; and, d. at least one propulsion means capable of propelling the vessel when the at least two hull members are either in the deployed or retracted positions, wherein at least a portion of each hull member is capable of being housed underneath the overhangs in the base of the primary hull when in the retracted position; and wherein the means for controllably deploying and retracting the member hulls is capable of deploying or retracting portions of the member hulls at different longitudinal positions between a fully deployed and fully retracted position.

10. The vessel of claim 9 wherein the means for controllably deploying and retracting the member hulls is capable of deploying or retracting portions of the member hulls at various angles.

11. A nautical vessel comprising:

a. a primary hull with a base facing external to the vessel further comprising at least two overhangs in the base of the primary hull;

b. at least two hull members each comprising a longitudinally extending hull body with a front end and a distal end;

c. a means for controllably moving the at least two hull members to and from a deployed position and a retracted position;

d. at least one propulsion means capable of propelling the vessel when the at least two hull members are either in the deployed or retracted positions, and e. at least one tension member that has two ends wherein one end is attached to one said at least two hull members and the other end is attached to said primary hull;

wherein at least a portion of each hull member is capable of being housed underneath the overhangs in the base of the primary hull when in the retracted position.

12. The vessel of claim 11 wherein said tension members comprise a cable.

13. The vessel of claim 1 further comprising a failsafe positive design wherein said at least two hull members retract while at sea.

14. The vessel of claim 1 further comprising a component that restricts deployment or retraction of said hull members when said vessel is traveling greater than a predetermined speed.

15. The vessel of claim 1 wherein said primary hull further comprises at least one compartment capable of housing personnel.

16. The vessel of claim 10 wherein the means the means for controllably deploying and retracting the member hulls deploys and retracts the hull members at user set angle.

17. The vessel of claim 13 wherein said at least two hull members are retracted in said fail safe positive design so that said hull members are at least partially housed underneath said overhang.

18. The vessel of claim 17 wherein said failsafe positive design allows for beaching, transiting long distances, and interfacing with a mother ship.

19. The vessel of claim 9 further comprising a component that restricts deployment or retraction of said hull members when said vessel is traveling greater than a predetermined speed.

20. The vessel of claim 11 further comprising a component that restricts deployment or retraction of said hull members when said vessel is traveling greater than a predetermined speed.

* * * * *